US007183512B2

(12) United States Patent
Lee et al.

(10) Patent No.: US 7,183,512 B2
(45) Date of Patent: Feb. 27, 2007

(54) KEY STRUCTURE

(75) Inventors: Tong-Shueh Lee, Taipei (TW); Shang-Chih Chuang, Hsinchuang (TW)

(73) Assignees: Lite-on Technology Corporation, Taipei (TW); Fu Hung Precision Co., Ltd., Taipei (TW)

( * ) Notice: Subject to any disclaimer, the term of this patent is extended or adjusted under 35 U.S.C. 154(b) by 0 days.

(21) Appl. No.: 11/216,155

(22) Filed: Sep. 1, 2005

(65) Prior Publication Data

US 2006/0049031 A1 Mar. 9, 2006

(30) Foreign Application Priority Data

Sep. 3, 2004 (TW) ..... 93126770 A

(51) Int. Cl.
*H01H 9/26* (2006.01)

(52) U.S. Cl. ..... 200/344; 200/5 A

(58) Field of Classification Search ..... 200/5 A, 200/517, 341–345; 400/490, 491, 491.2, 400/495, 496, 495.1
See application file for complete search history.

(56) References Cited

U.S. PATENT DOCUMENTS 6,444,933 B1 * 9/2002 Chun ..... 200/344
6,706,986 B2 * 3/2004 Hsu ..... 200/344
6,812,421 B2 * 11/2004 Sato et al. ..... 200/344

* cited by examiner

*Primary Examiner*—Michael Friedhofer
*Assistant Examiner*—Lisa Klaus
(74) *Attorney, Agent, or Firm*—Birch Stewart Kolasch & Birch, LLP

(57) ABSTRACT

A key structure has a support member that reduces manufacturing costs, assembly costs, and the total height of the manufactured product. The support member is mounted between a base and a key cap. The support member has a first frame and a second frame, which are both formed in a united manner by injection. The first frame has a base portion and a pair of side arms connected with the base. The side arms both have a penetrated transverse pivotal hole formed therein. The second frame is disposed between the side arms and has a pair of pivots protruded respectively from two sides thereof. The pivots are formed and mounted directly in the pivotal holes during ejection molding, and an annular channel is formed for receiving a tubular mold during ejection molding.

18 Claims, 6 Drawing Sheets

KEY STRUCTURE

BACKGROUND OF THE INVENTION

1. Field of the Invention

The present invention relates to a key structure, particularly to a key structure having a scissor-like linkage structure which is adapted for an electronic product with keys, such as a notebook computer, a computer keyboard, a telephone, a printer or a multi-function printer, for controlling key strokes.

2. Description of the Prior Art

Keyboards are widely used with various devices, such as computers, and notebooks, to input characters and numerals. Especially concerning notebooks, space is limited and the keyboard structure is particularly important. To make a key on the keyboard easy to depress, the key is usually designed with a scissors-like linkage structure (often called a support member) to function no matter where force is exerted on the key cap. In other words, even though the force is exerted on the edge of the key cap, the force is generally equally distributed over the entire surface of the key cap by the scissors-like linkage structure. Furthermore, while space is an especially important consideration in designing keyboards for portable computing devices, key switches with scissors-like linkage structure are often the solution.

Please refer to FIG. 1, which illustrates a perspective explored view of a key structure according to the prior art. The key structure has a key cap 90, a scissors-like linkage structure consisting of a first frame 91 and a second frame 92, and a base 93. The bottom ends of the first frame 91 and the second frame 92 are formed with pivots 94, 95 respectively for connecting pivotally with pivotal seats 96, 97 on the base 93. The top ends of the first frame 91 and the second frame 92 connect pivotally to the bottom surface of the key cap 90.

The first frame 91 and the second frame 92 are often formed by the injection molding technique. Connection mechanisms are provided on the middle portion of the first and second frames, so that the first and second frames are rotatably connected with each other to form the scissors-like linkage structure. However, in the conventional connection mechanism, the first frame and the second frame must be respectively formed on two independent areas during the injection molding process. Therefore, the necessary area for forming the scissors-like linkage structure is relatively large, resulting in an increase in manufacturing costs and the complication of the assembly of the inner and outer arms.

During the assembly of the scissors-like linkage structure, a step of separating the first frame and the second frame is performed first. Then, the two independent frames are sophisticatedly connected through the connection mechanism to form the scissors-like linkage structure. Therefore, the assembly process is relatively complicated and time-consuming, which induces the high assembly costs.

For solving the above-mentioned disadvantages, U.S. Pat. No. 6,706,986 published on Mar. 16, 2004 provides a scissors-like linkage structure for reducing injection molding costs and assembly costs. Please refer to FIG. 2, which shows a scissors-like linkage structure 70 applied in a key structure 60 for connecting a key cap 62 to a base 64 of the prior art. The scissors-like linkage structure 70 has a first frame 72 and a second frame 74. Each of the side arms of the second frame 74 are formed with a first hole 742 and a second hole 744 connecting to each other. Please refer to FIGS. 3A and 3B, which respectively illustrate a side view and a top view of the conventional scissors-like linkage structure. The scissors-like linkage structure is formed in a united manner by the injection molding technique. After injection, two pivots 720 of the first frame 72 are positioned in the first holes 742 of the second frame 74 and are moved along the radial direction. A space 700 is formed between the first frame 72 and the second frame 74, so that the second frame 74 can move in the first frame 72. The next step is moving the pivots 720 so that they hook into the second hole 744 and unite together. However, unavoidably, the scissors-like linkage structure of this prior art still needs one labor assembly step, which is pushing the pivots 720 of the first frame 72 into the second holes 744 of the second frame 74. Such step not only raises labor costs, but also increases the possibility of damage caused by improper assembly.

Moreover, the above mentioned scissors-like linkage structure 70 requires that the first hole 742 that is bigger than that of before, so that it increases the total height of the key structure and the height of the electronic device. It is therefore poorly designed for notebook computer keyboards.

Furthermore, the assembly action of the scissors-like linkage structure 70 pushing the first frame 72 into the second frame 74 results in a lateral force being applied to the pivots 720 of the first frame 72. The lateral force may cause the pivots 720 to break and raises the possibility of the product breaking down.

Besides, the scissors-like linkage structure 70 has the space 700 formed between first frame 72 and the second frame 74 let the second frame 74 move, so that the area of the mold of the scissors-like linkage structure 70 needs to be larger than the area of a mold of a single frame.

The inventor, after investigation and research, thus provides the present invention of logical design for reducing injection costs and reducing the number of assembly steps to overcome the above-mentioned imperfections.

SUMMARY OF THE INVENTION

The present invention provides a key structure having a scissor-like linkage structure that can reduce injection costs, reduce assembly costs, and lower the total height of a manufactured product. It applies single injection technology that form pivots directly in the pivotal holes of the scissor-like linkage structure. The present invention not only reduces the injection molding area, thereby reducing injection costs, but also avoids assembly steps completely. The present invention can save labor assembly costs, and avoid the possibility of product assembly failure.

The present invention provides a key structure comprising a base, a support member, and a key cap. The support member is connected with the base. The support member is formed in a united manner, and comprises a first frame and a second frame. The first frame has a base portion and a pair of side arms respectively connecting with two sides of the base portion. Each of the side arms has a transverse-through pivotal hole formed therein. The second frame is positioned between the side arms and has a pair of pivots protruding from two sides thereof. The pair of pivots are formed in the pivotal holes respectively. The key cap is mounted above the support member and connected to the support member.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
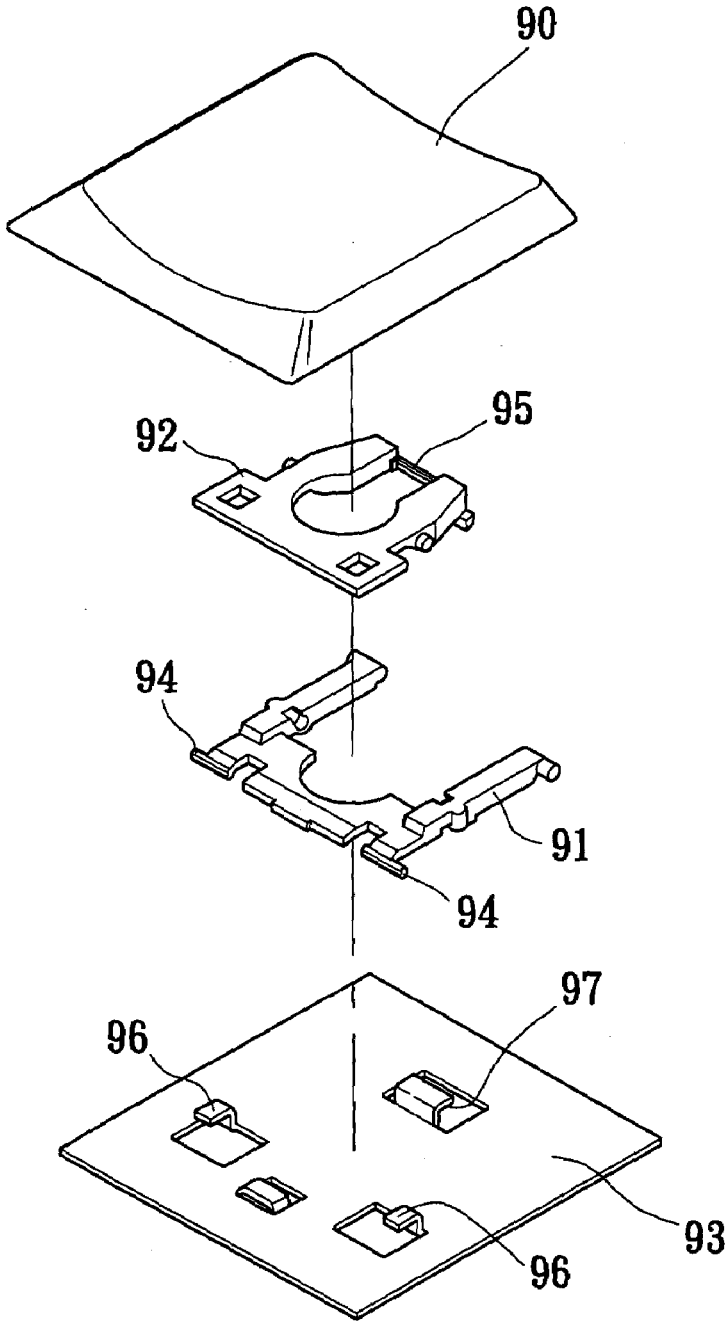
FIG. 1 PRIOR ART
FIG. 1 is an exploded perspective view of a key structure according to the prior art.
Figure 2:
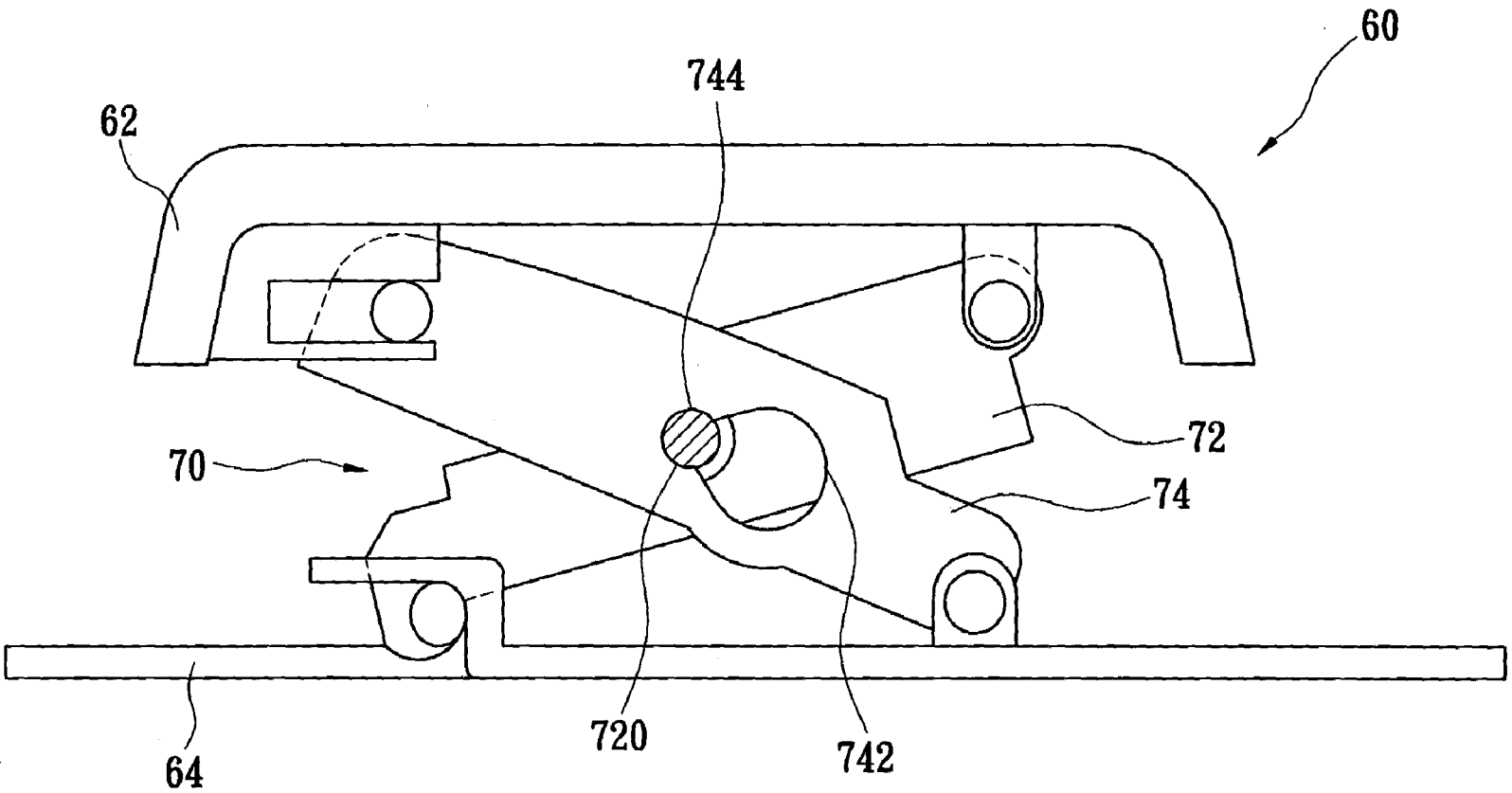
FIG. 2 PRIOR ART
FIG. 2 is a side assembly view of a key structure according to another prior art.
Figure 3A:
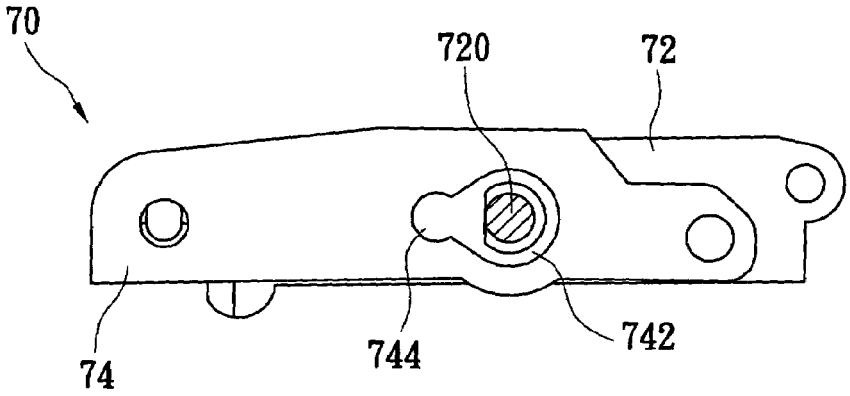
FIG. 3A PRIOR ART
FIG. 3A is a side view of a scissors-like linkage structure of the key structure according to another prior art.
Figure 3B:
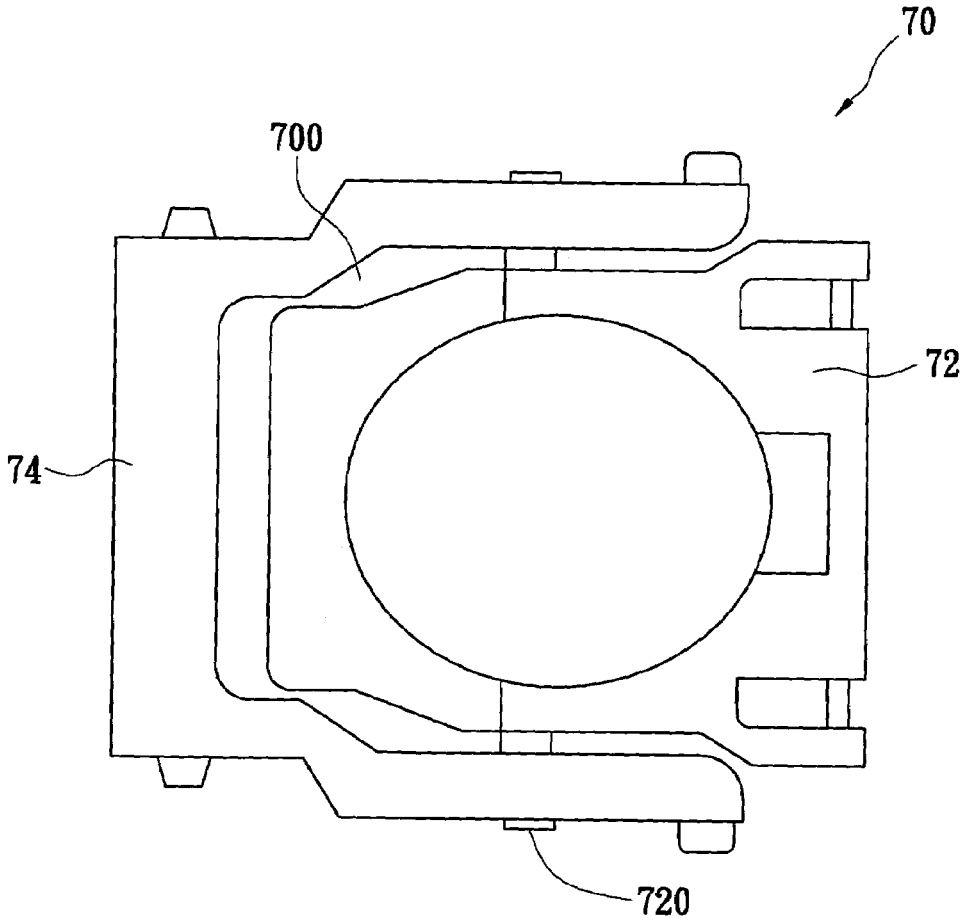
FIG. 3B PRIOR ART
FIG. 3B is a top view of a scissors-like linkage structure of the key structure according to another prior art.
Figure 4:
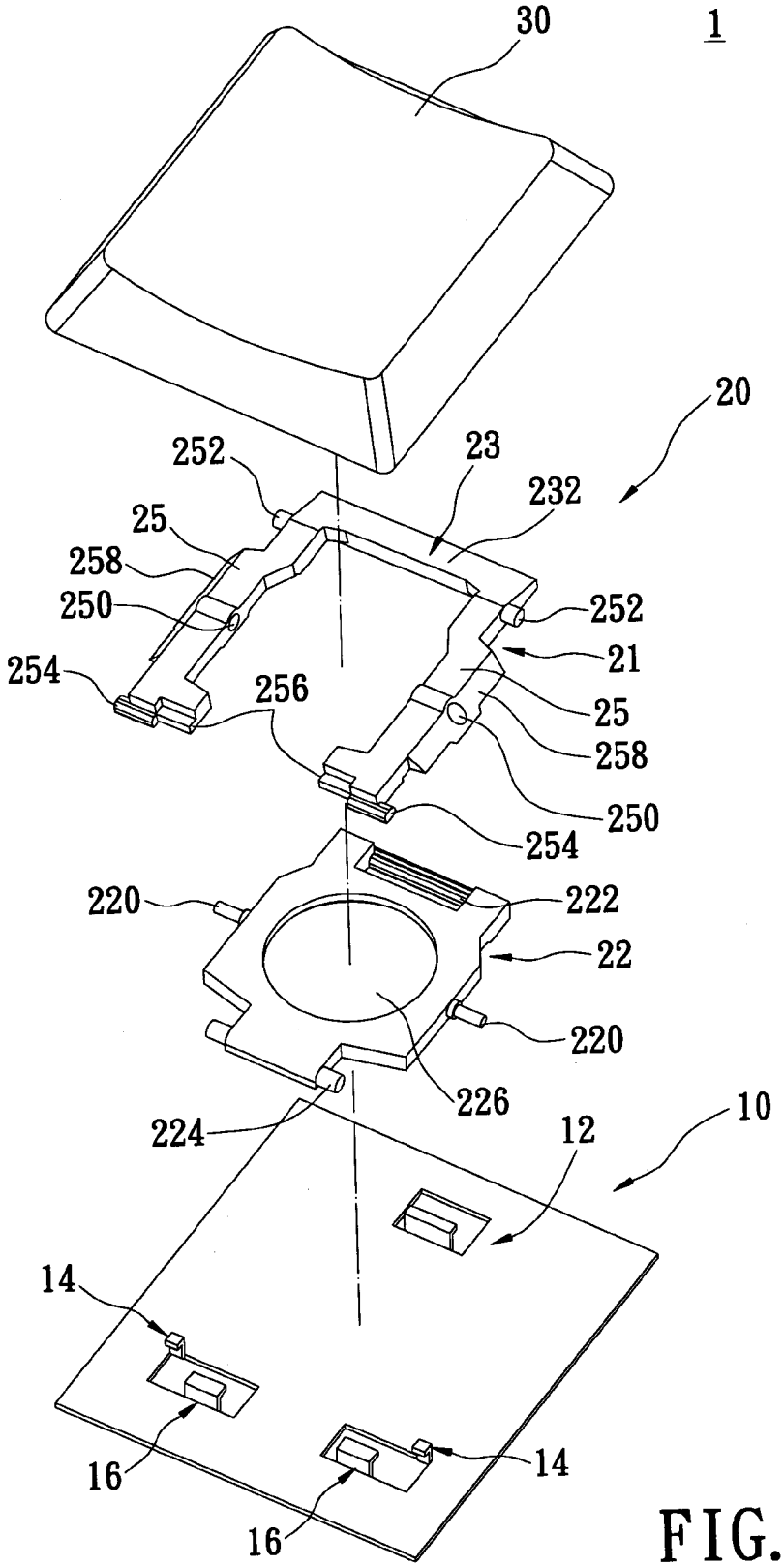
FIG. 4 is an exploded perspective view of a key structure of preferred embodiment according to the present invention.

Please refer to FIG. 4, which illustrates an exploded perspective view of a key structure of the preferred embodiment according to the present invention. The present invention provides a key structure 1 comprising a base 10, a support member 20 and a key cap 30. The support member 20 is removably connected with the base 10. The key cap 30 is mounted above the support member 20 and connected to the support member.

The base 10 is formed with a front hook 12 and two rear hooks 14 for connecting pivotally with the support member 20.

Figure 5:
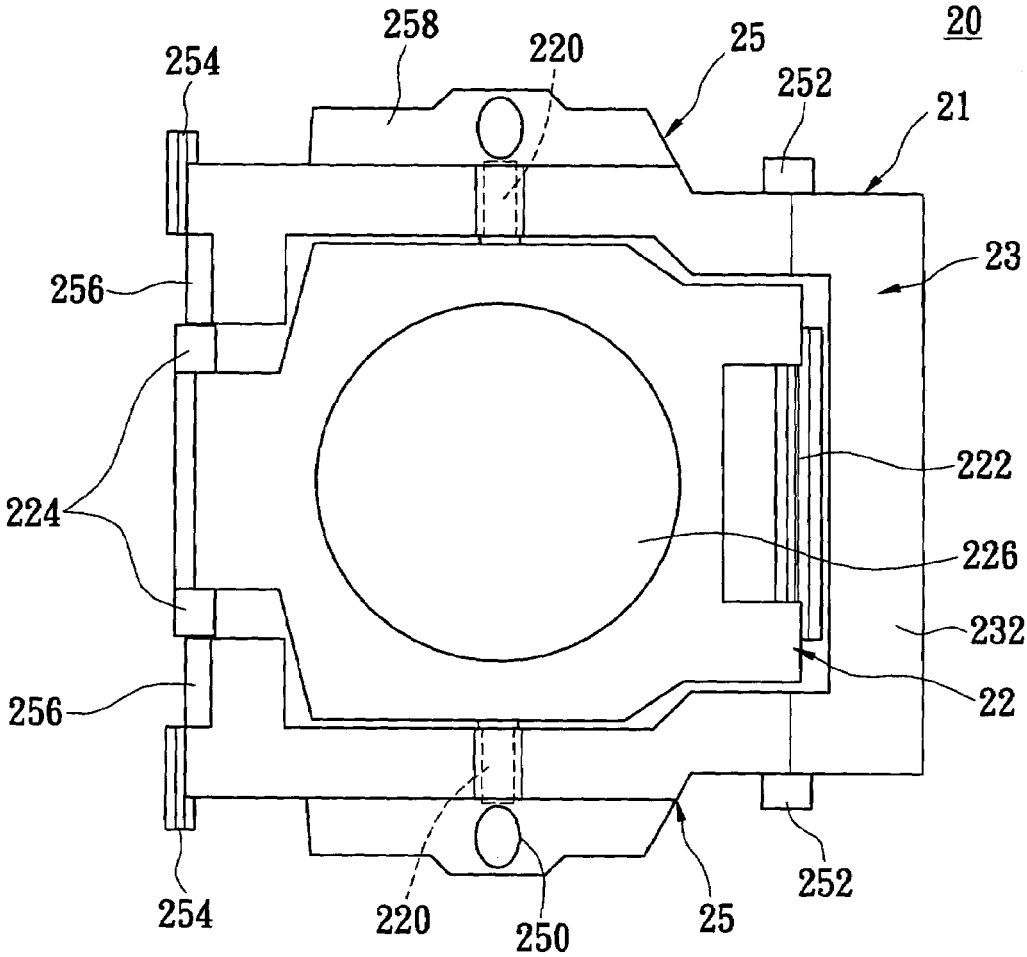
FIG. 5 is a top view of a support member of the key structure according to the present invention.
Figure 6:
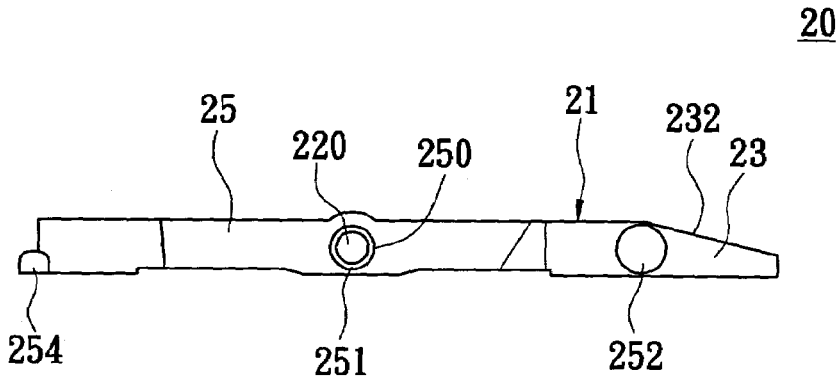
FIG. 6 is a side view of a support member of the key structure according to the present invention.

Please refer to FIGS. 5 and 6, which respectively illustrate a top view and a side view of a support member of the key structure according to the present invention. The support member 20 comprises a first frame 21 and a second frame 22, which are formed by integral injection and are incorporated together during manufacturing procedure. In other words, there is no need to manufacture the first frame 21 and the second frame 22 separately and to have an additional process of assembly of the first frame 21 and the second frame 22 with each other. The first frame 21 has a base portion 23 and a pair of side arms 25 extending from each end of the base portion 23, respectively. Each of the side arms 25 has a transverse-through pivotal hole 250 formed therein. The second frame 22 is positioned between the side arms 25 and has a pair of pivots 220 protruding from each side thereof. The pivots 220 are formed to be within the pivotal holes 250 respectively, and a pair of annular channels 251 the pivotal holes 250 around the pivots 220, wherein the annular channels 251 are respectively received with a tubular mold during the injection shaping.

The support member 20 of the present invention has the advantage of being shaped once by injection. In other words, the support member 20 is assembled immediately after injecting the melted material into a single mold, i.e. the first frame 21 and the second frame 22 are formed directly in an assembled condition so that no assembly is required. Therefore, labor costs are reduced.

The mold of the support member 20 consists of upper and lower molds and two lateral tubular molds. The second frame 22 is disposed in the first frame 21 with an interval and without an overlapping portion. The upper and lower molds clip together to form a first frame cavity at an outer periphery, a second frame cavity at an inner side, and a pair of outward circle molding holes formed on two sides of the upper and lower molds. A pair of pivot root channels are formed between the first frame cavity and the second frame cavity. Each of the circle molding holes is received with a thin tubular mold, which extends to the inner edges of the first frame cavity. A hollow portion of the thin tubular mold connects tightly with the pivot root channel. Next, melted material is injected through injection holes of the upper mold, and expels the air in the mold cavity via exhaust holes. After injecting the material, the solid portion of the tubular mold forms the annular channel 251; the hollow portion of the tubular mold and the pivot root channel form the pivot 220. After it has cooled down, the tubular molds are drawn out from the two sides and separated the upper and lower molds.

The pivot 220 of the support member 20 has a thicker root adjacent to the second frame 22, i.e., the pivot 220 has a portion, which is located within the pivotal hole 250, with a diameter smaller than that of the remainder of the pivot 220 outside the pivotal hole 250.

The first frame 21 comprises a pair of front shafts 252 and a pair of rear shafts 254 which are respectively formed on the opposited ends of the side arms 25. The front shafts 252 are adjacent to the base portion 23, and the rear shafts 254 are positioned on ends of the side arms 25. The front shafts 252 are pivotally connecting to the bottom of the key cap 30, and the rear shafts 254 are pivotally connected to the rear hooks 14 of the base 10.

The second frame 22 comprises a central port 226, a transverse shaft 222 and a pair of shafts 224. The transverse shaft 222 is aligned with the front shafts 252 of the first frame 21, and the shafts 224 are aligned with the rear shafts 254 of the first frame 21. The transverse shaft 222 is pivotally connected to the front hook 12 of the base 10, and the shafts 224 are pivotally connected to the bottom of the key cap 30.

The base portion 23 of the first frame 21 is formed with an outward oblique surface 232. The oblique surface 232 is against a bottom surface of the key cap 30, when the support member 20 is raised in a crisscross manner (usually by an elastic dome). Therefore, the oblique surface 232 has the functions of stopping and positioning. In other words, when the support member 20 is raised to a predetermined position, the oblique surface 232 props up the bottom surface of the key cap 30 and stops the support member 20 from continuing to rise.

A central portion of the side arms 25 of the first frame 21 has a width being substantially equal to that of a bottom surface of the key cap 30. Each of the side arms 25 are formed with an outward oblique surface 258 on the central portion thereof. The oblique surfaces 258 of the side arms 25 are forced against two sides of the bottom surface of the key cap 30, when the key cap 30 is depressed. Therefore, the key cap 30 is supported better when it is depressed to the end, and performs better.

In this embodiment, the first frame 21 further has a pair of stopping blocks 256 which extend inwardly from ends of the side arms 25 respectively. The base 10 is formed with a pair of stoppers 16 corresponding to the pair of stopping blocks 256. The stopping blocks 256 are forced against the stoppers 16 when the key cap 30 is depressed. The stoppers 16 hold and stop the stopping blocks 256 in place when a key is depressed. The stoppers 16 stop the key from wavering or rotating and ensure equilibrium when a key is depressed, so that the stability and balance of the key are enhanced.

Figure 7:
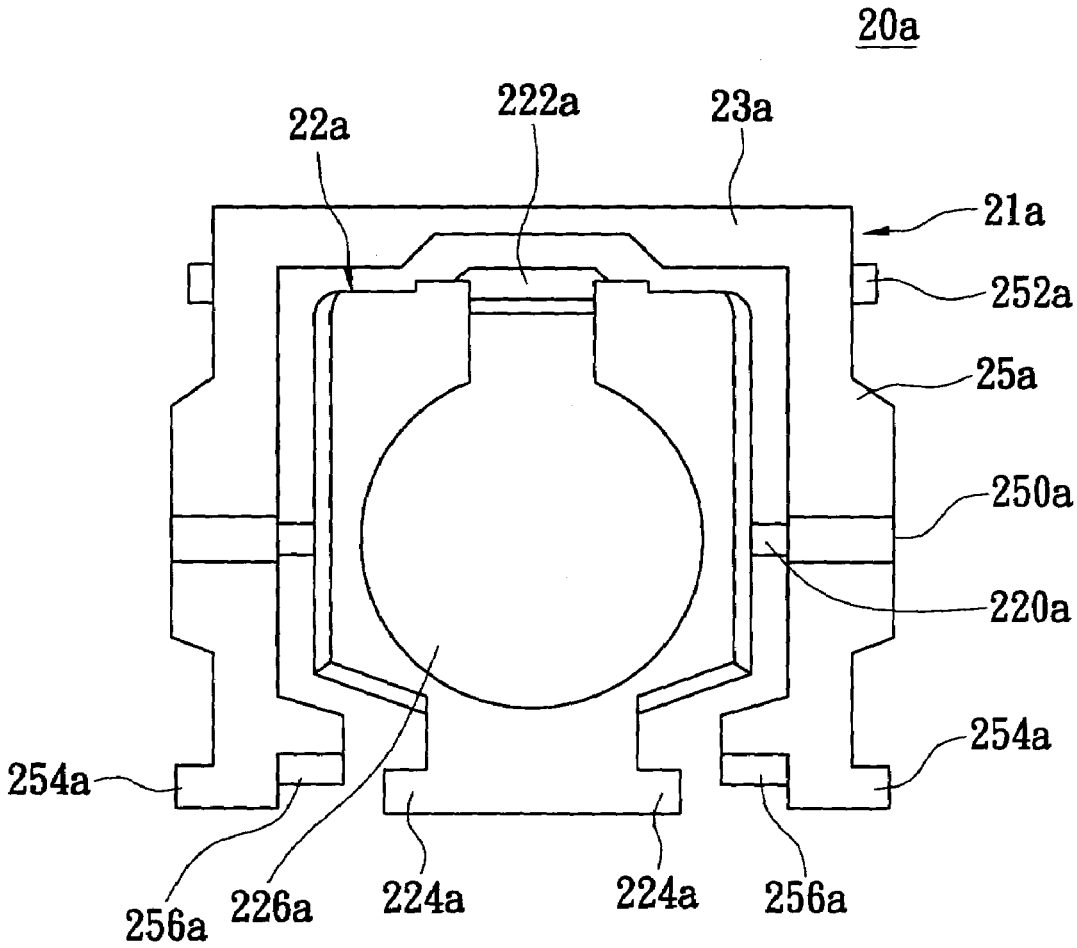
FIG. 7 is a top view of a support member of the key structure of the second embodiment according to the present invention.

Please refer to FIG. 7, which illustrates a top view of a support member of the key structure of the second embodiment according to the present invention. The different sized key needs a different sized support member. By applying the character of integral injection to the present invention, support members of different sizes are possible. Therefore, the shape of the present invention is not limited by the above embodiments. The second embodiment provides a support member 20*a*, which comprises a first frame 21*a* and a second frame 22*a*. The first frame 21*a* has a base portion 23*a* and a pair of side arms 25*a* connected with two sides of the base portion 23*a*. Each of the side arms 25*a* has a transverse-through pivotal hole 250*a* formed therein. The second frame 22*a* is positioned between the side arms 25*a* and has a pair of pivots 220*a* protruding from two sides thereof. The pair of pivots 220*a* are mounted in the pivotal holes 250*a* respectively and form an annular channel around the pivots 220*a*. The first frame 21*a* comprises a pair of front shafts 252*a*, a pair of rear shafts 254*a*, which are respectively formed on two sides of the side arms 25*a*, and a pair of stopping blocks 256*a* protruding from the inner sides of the side arms 25*a*. The second frame 22*a* comprises a central port 226*a*, a transverse shaft 222*a* and a pair of shafts 224*a*.

A summary of the characteristics and advantages of the present invention is as follows:

1. The support member (or called scissors-like linkage structure) is formed in a united manner by integral injection technology. The second frame is pivotally connected to the first frame directly. The present invention does not need labor for separating frames and assembling. It simplifies the assembly processes and saves time and labor, thereby reducing labor costs.

2. The present invention reduces the mold area of injection, and is almost equal to one frame, thereby saving on mold costs and reducing the occupied space effectively.

3. The support member is formed compactly, which controls the total height to about the height of the pivotal hole, and does not increase the total height, therefore, it is beneficial for the development of notebook computers.

4. The oblique surfaces 258 are forced against the bottom surface of the key cap 30 after the key cap is depressed, and the oblique surface 232 is forced against the bottom surface of the key cap 30 when the support member 20 rises. The support member 20 ensures a smoother feeling when typing.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A key structure, comprising:

a base;

a support member attached to the base, the support member including a first frame and a second frame formed and incorporated at one time, the first frame having a base portion and a pair of side arms respectively extending from each end of the base portion, each of the side arms having a transverse-through pivotal hole formed therein, the second frame being positioned between the side arms and having a pair of pivots protruding from each sides thereof, wherein the pair of pivots are located within the pivotal holes respectively, wherein the first frame further comprises a pair of stopping blocks extending inwardly from ends of the side arms; and a key cap mounted above the support member and connected to the support member.

2. The key structure as claimed in claim 1, wherein a portion of the pivot being within the pivotal hole has a diameter smaller than that of the remainder of the pivot outside the pivotal hole.

3. The key structure as claimed in claim 1, wherein the first frame comprises a pair of front shafts and a pair of rear shafts respectively formed on two sides thereof, wherein the front shafts are adjacent to the base portion, and the rear shafts are positioned on ends of the side arms.

4. The key structure as claimed in claim 3, wherein the second frame comprises a central port, a transverse shaft and a pair of shafts, wherein the transverse shaft is aligned with the front shafts of the first frame, and the shafts are aligned with the rear shafts of the first frame.

5. The key structure as claimed in claim 1, wherein the base portion is formed with an outward oblique surface, and the oblique surface is against a bottom surface of the key cap when the support member rises in a crisscross manner.

6. The key structure as claimed in claim 1, wherein a central portion of the side arms of the first frame has a width being substantially equal to that of a bottom surface of the key cap.

7. The key structure as claimed in claim 6, wherein each of the side arms is formed with an outward oblique surface on the central portion thereof, and the oblique surfaces of the side arms are forced against two sides of the bottom surface of the key cap when the key cap is depressed.

8. The key structure as claimed in claim 1, wherein the base is formed with a pair of stoppers corresponding to the pair of stopping blocks, the stopping blocks are forced against the stoppers when the key cap is depressed.

9. The key structure as claimed in claim 1, wherein each of the pivots is formed in the pivotal holes, and a pair of annular channels are respectively formed in the pivotal holes around the pivots, wherein the annular channels are respectively received with a tubular mold during injection shaping.

10. A support member of the key structure, comprising:

a first frame, having a base portion and a pair of side arms respectively extending from each end of the base portion, each of the side arms having a transverse-through pivotal hole formed therein, wherein each of the side arms is formed with an outward oblique surface on a central portion thereof, and the oblique surfaces of the side arms are forced against two sides of a bottom surface of the key cap when the key cap is depressed to the end; and a second frame, positioned between the side arms, and having a pair of pivots protruding from two sides thereof, wherein the pivots are formed and incorporated to be within the pivotal holes.

11. The support member of the key structure as claimed in claim 10, wherein a portion of the pivot located inside the pivotal hole has a diameter smaller than that of the remainder of the pivot outside the pivotal hole.

12. The support member of the key structure as claimed in claim 10, wherein the first frame comprises a pair of front shafts and a pair of rear shafts respectively formed on two sides thereof, wherein the front shafts are adjacent to the base portion, and the rear shafts are positioned on ends of the side arms.

13. The support member of the key structure as claimed in claim 12, wherein the second frame comprises a central port, a transverse shaft and a pair of shafts, wherein the transverse shaft is aligned with the front shafts of the first frame, and the shafts are aligned with the rear shafts of the first frame.

14. The support member of the key structure as claimed in claim 10, wherein the base portion is formed with an outward oblique surface, the oblique surface is forced against a bottom surface of the key cap when the support member rises in a crisscross manner.

15. The support member of the key structure as claimed in claim 10, wherein a central portion of the side arms of the first frame has a width being substantially equal to that of a bottom surface of the key cap.

16. The support member of the key structure as claimed in claim 10, wherein the first frame further comprises a pair of stopping blocks extending inwardly from ends of the side arms respectively.

17. The support member of the key structure as claimed in claim 16, wherein the base is formed with a pair of stoppers corresponding to the pair of stopping blocks, the stopping blocks are forced against the stoppers when the key cap is depressed.

18. The support member of the key structure as claimed in claim 10, wherein each of the pivots is formed to be within the pivotal holes, and annular channels are respectively formed in the pivotal holes around the pivots, wherein the annular channels are respectively received with a tubular mold during injection shaping.

* * * * *